US005164735A

United States Patent [19]

Reich et al.

[11] Patent Number: 5,164,735

[45] Date of Patent: Nov. 17, 1992

[54] OPTICAL IMPLEMENTATION OF A SPACE FED ANTENNA

[75] Inventors: Stanley M. Reich, Jericho; Carmine F. Vasile, Patchogue, both of N.Y.

[73] Assignee: Grumman Aerospace Corporation, Bethpage, N.Y.

[21] Appl. No.: 788,372

[22] Filed: Nov. 6, 1991

[51] Int. Cl.[5] ..... H01Q 3/34; H01Q 3/36

[52] U.S. Cl. ..... 342/368; 342/372

[58] Field of Search ..... 342/368, 369, 371, 372, 342/373, 374, 376, 377

[56] References Cited

U.S. PATENT DOCUMENTS

| | | | |
|---|---|---|---|
| 3,878,520 | 4/1975 | Wright et al. | 342/368 |
| 4,028,702 | 6/1977 | Levine | 342/374 |
| 4,258,363 | 3/1981 | Bodmer et al. | 342/157 |
| 4,620,193 | 10/1986 | Heeks | 342/200 |
| 4,725,844 | 2/1988 | Goodwin et al. | 342/374 |
| 4,929,956 | 5/1990 | Lee et al. | 342/376 |
| 4,965,603 | 10/1990 | Hong et al. | 342/372 |
| 5,008,680 | 4/1991 | Willey et al. | 342/372 |
| 5,051,754 | 9/1991 | Newberg | 342/375 |
| 5,061,937 | 10/1991 | Ozeki et al. | 342/372 |

*Primary Examiner*—John B. Sotomayor

*Attorney, Agent, or Firm*—Pollock, VandeSande & Priddy

[57] ABSTRACT

To eliminate bulkiness associated with the conventional transmission of control signals to a phase array, and to overcome the precise requirements needed to coherently control a phase array in the prior art, the present invention uses incoherent light to provide optical synchronization of the phase array. For the system of the present invention, incoherent light, in the form of different optical signals having multiplexed thereon a local oscillator signal and a command signal including a plurality of control signals, are summed by a wavelength division multiplexer and sent, over an air path, to each TR module of the phase array. On receipt, each TR array separates from the summed optical signal the oscillator signal and a control signal which is recognizable and to be used only by that TR module. The separated oscillator signal is next fed to a mixer, for modulating a radar signal. The separated control signal provides weighting to the amplitude and phase of the modulated radar signal, relative to the other modulated radar signals from the other TR modules of the array. When all of the modulated radar signals are transmitted from the array, a coherently synchronized radar wave front is provided.

19 Claims, 3 Drawing Sheets

OPTICAL IMPLEMENTATION OF A SPACE FED ANTENNA

FIELD OF THE INVENTION

The present invention relates to transmitter/receiver (TR) modules for use in a phase array, and more particularly to the use of incoherent light to optically synchronize the TR modules of the array.

BACKGROUND OF THE INVENTION

Usually the distribution system for a TR module array includes waveguides or coaxial cables, depending on the specific application of the array. Since both the waveguides and the coaxial cables are bulky and cumbersome to use, the connection of the processing center wherein the signals to control the TR modules are generated and the TR modules requires extensive work and space.

Instead of using waveguides and coaxial cables, coherent light may also be used to control the TR modules in a phase array. However, the use of coherent light means the multiplexing of different high frequency light signals. The multiplexing of high frequency light signals in turn requires that the physical dimensions of the transmitting apparatus (such as lenses), the polarization of the transmission path, and the detection scheme be held very stable over ambient temperature. Yet mechanical stresses which are present in the environment onto which the phase array is mounted, such as an aircraft or a spacecraft, tend to be greater than those in the ambient environment.

In a related copending application entitled Optical Control of TR Modules by the same inventors of this application having Ser. No. 07-788,373 filed Nov. 6, 1991, and incorporated herein by reference, it was disclosed that incoherent light transported through an optical fiber may be used to control the phase array. But in instances where a physical connection between the incoherent light source and the phase array may not be feasible, such as in a spacecraft or between ships, another method and system which would provide incoherent optical synchronization o a phase array is required.

BRIEF DESCRIPTION OF THE PRESENT INVENTION

To provide incoherent optical synchronization and control of a phase array, different optical signals are generated in a fusion center, or a processing center, onto which a local oscillator signal and a command signal, also generated in the same fusion center, are multiplexed. The command signal includes a plurality of control signals each of which has a specific address that is recognizable only by one of the TR modules in the phase array. Alternatively, a plurality of command signals may also be used and these command signal may then be multiplexed onto the different optical signals. Take the case of only two optical signals having multiplexed thereon respective oscillator and command signals. These optical signals are summed by a wavelength division multiplexer, such that only one optical signal results therefrom. This single summed optical signal is then spatially transmitted to the array whereupon the respective TR modules receives this summed optical signal. In the meantime, a radar signal, also generated within the processing center, is also spatially sent to each TR module of the array.

On receipt of the summed optical signal, each TR module, by using a wavelength division demultiplexer, separates the oscillator signal and its corresponding recognized control signal. The thus separated oscillator signal is routed to a mixer to modulate the radar signal, thereby effectively providing a local oscillator for the TR module. The control signal, meanwhile, is deciphered by the decoder, and the information containing therein is used to set the phase and amplitude of the modulated radar signal, relative to other modulated radar signals from the other TR modules. When transmitted toward an of-interest target by the antennas of the corresponding TR modules, the modulated radar signals, in combination, effectively provides a coherently synchronized radar waveform for the target. Since the system of the present invention transmits its control signals optically, it becomes very difficult for a jamming signal to interfere with the control signals.

It is, therefore, an objective of the present invention to provide a distribution system that can use incoherent light to synchronously control a phase array.

It is another objective of the present invention to provide a system which can optically synchronize a phase array spatially.

It is yet another objection of the present invention to provide for a system to optically synchronize a phase array which is immune to interference.

The above-mentioned objectives and advantages of the present invention will become more apparent and the invention itself will be best understood by reference to the following description of the invention taken in conjunction with the accompanying drawings, wherein:

DETAILED DESCRIPTION OF THE PRESENT INVENTION

Figure 1:
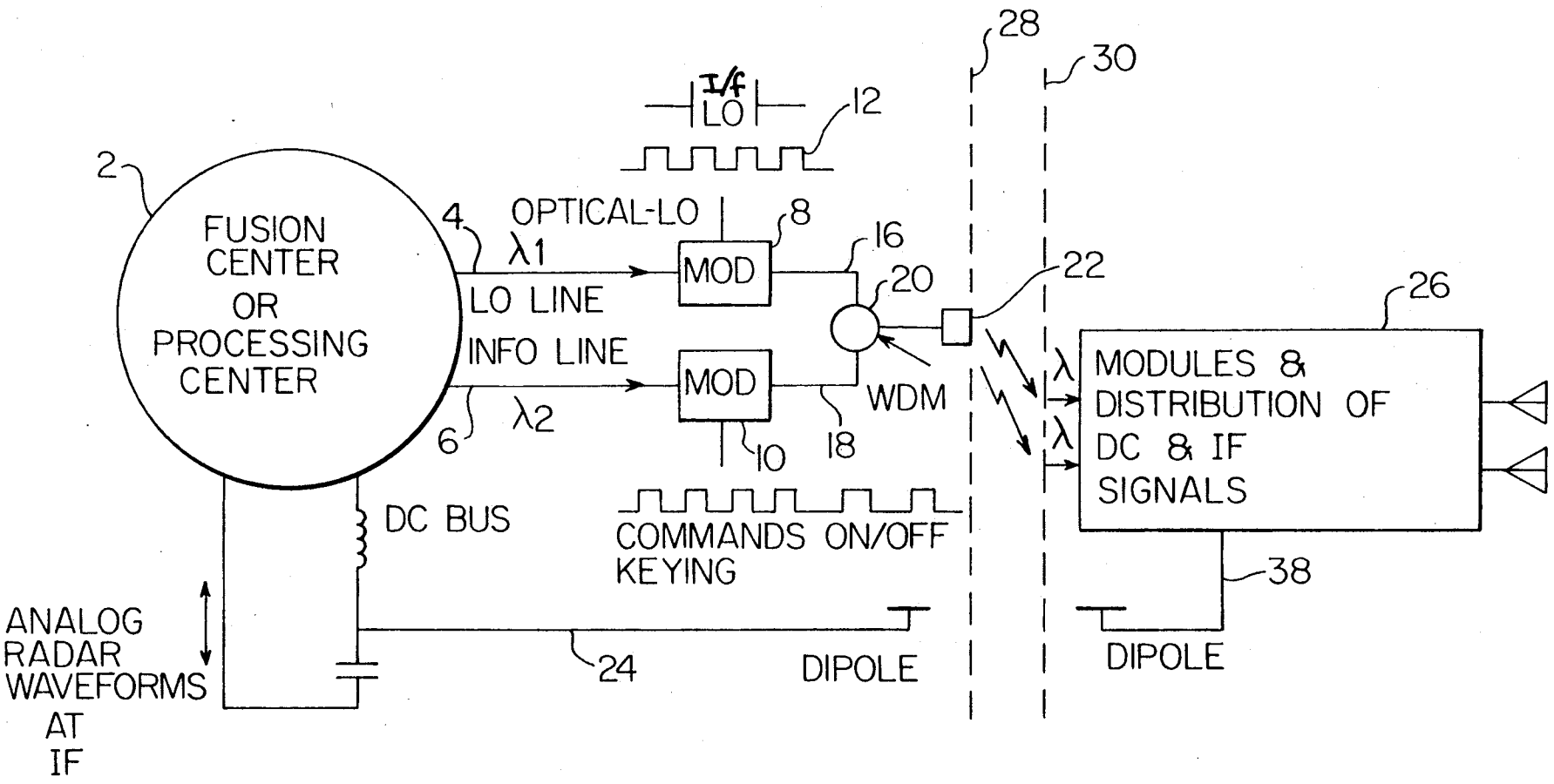
FIG. 1 is a simplified block diagram of an overall view of the system of the present invention.

A simplified block diagram of the overall system of the present invention is given in FIG. 1. In fusion center or processing center 2, the operation and description of which is given in publication entitled *Radar Hand Book*, 2nd edition 1990, Merrill Skolnik, there is generated a plurality of signals such as a local oscillator signal, a radar signal, a plurality of optical signals and at least one command signal. To generate the respective signals, conventional methods and conventional apparatus may be used. For example, to generate the optical signals, semiconductor diode lasers may be used. And by using differently colored lasers (or filters), optical signals having different wavelengths may be generated. Likewise, the generation of the radar signal is conventional and involves conventional apparatus which is well known to those skilled in the art. The oscillator signal is generated by an oscillator resident in fusion center 2 and, in effect, provides timing for the system.

As for the command signals, these too are generated by conventional apparatus and represent predetermined parameters used to, among other things, control the phases and amplitudes of the respective TR modules in the array. There are at least two alternative approaches in the design of the system which determines the number of command signals to be generated. For alternative one, a single command signal may be generated in fusion center 2, the single command signal including a plurality of control signals each of which has an address that is recognizable by only one of the TR modules. Thus, the single command signal may be multiplexed onto a chosen wavelength of an optical signal. For the alternative approach, a plurality of command signals, each to work cooperatively with one of the TR modules to provide control therefor, may be used. In this approach, instead of a single optical signal, a plurality of signals, corresponding in number to the plurality of command signals, is required since each command signal has to be multiplexed onto a corresponding optical signal.

The multiplexing (or superimposing) of the oscillator signal and command signal(s) onto respective optical signals may be effected either within or outside of fusion center 2. Assume for this discussion that only one command signal having a plurality of control signals is used. Thus, if the multiplexing is done within fusion center 2, a direct modulation of the respective optical signals by the oscillator signal and the command signal occurs. Putting it simply, the electrical current feeding the respective laser sources can be varied such that the different direct modulations can occur.

However, multiplexing of the respective optical signals for the embodiment shown in FIG. 1 is done outside of fusion center 2. As illustrated, two optical signal lines 4 and 6, designated as Lo and Info lines, respectively, are provided as outputs from fusion center 2. Line 4 is used to carry the optical signal representative of the local oscillator signal, henceforth referred to as simply the oscillator signal; whereas line 6 is used to carry the optical signal that is representative of the command signal. The respective oscillator signals and command signals are represented by $g_1$ and $g_2$. These optical signals are fed to corresponding conventional modulators 8 and 10.

The oscillator optical signal is modulated in modulator 8 by a pulse train 12 while the command signal is being modulated in modulator 10 by a different pulse train 14. With the respective modulations, there is provided at the outputs of the corresponding modulators an optical synchronization signal and an optical command signal at lines 16 and 18, respectively. These optical signals are combined by a conventional wavelength division multiplexer 20 such that a single summed optical signal which has multiplexed thereon, at different wavelengths, both the oscillator signal and the command signal is provided at the output of wavelength division multiplexer 20 and fed to a transmitter 22.

Figure 3:
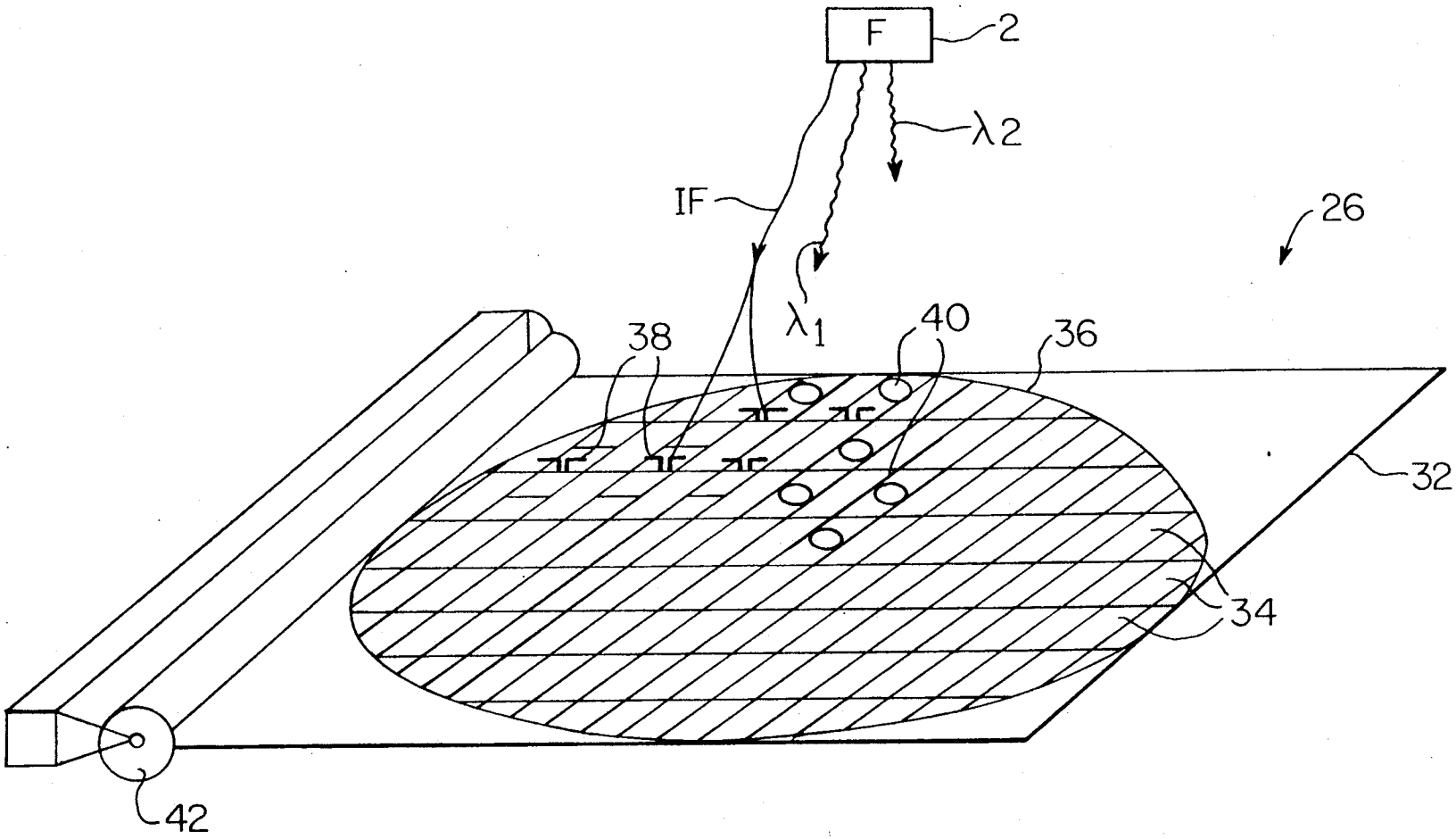
FIG. 3 shows a perspective view of an array having integrated thereon a plurality of TR modules.

For this embodiment, transmitter 22 may be comprised of a scanning step device such as that described in *Laser Applications*, edited by Monte Ross 1974 (Chapter by Leo Beiser), pp. 52–155 or *Laser Beam Scannino*, edited by Gerald C. Marshall 1985. In essence, such scanning step transmitter is able to direct the summed optical signal onto the array of TR modules, either individually or in groups, as shown in FIG. 3. Alternatively, transmitter 22 may be comprised of a moveable reflector, such as a mirror, that is actuated by a motor, such as a stepping motor. The signals for controlling the stepping motor are, of course, generated in fusion center 2 and are well known to those skilled in the art. Using either approach, a single summed optical signal is directed to the TR module array.

The analog radar waveforms, also generated in fusion center 2, in the meantime, is being transmitted as an IF signal, via dipole antenna 24, to the respective TR modules of array 26.

As shown in FIG. 1, array 26 is separated by dotted lines 28 and 30 from fusion center 2 and the components associated therewith. The space between lines 28 and 30 represents an air path which, as should be appreciated, can vary. Although represented by a single block in FIG. 1, with reference to FIG. 3, it can be seen that array 26 is comprised of a thin sheet of flexible material 32, such as Teflon or Kapton. Mounted on top of sheet 32 and integrated thereto is a plurality of TR modules 34 located within a circle 36. Mounted onto each of the TR modules is a corresponding dipole antenna 38 (also shown in FIG. 1) which is used to receive the radar IF signal from fusion center 2. Only a few of the dipole antennas are represented. Ditto for lenses 40 which are mounted on top of each of the TR modules. These lenses, for example, are graded index optic lenses and are made by the Nippon Sheet Glass Company of Japan, and are used to receive the summed optical signal from fusion center 2, represented in FIG. 3 as block F. Other small lenses could be used as well. Further with reference to FIG. 3, it should be appreciated that the summed optical signal is being shown by its separated components, i.e. the local oscillator signal $g_1$ and the command signal $g_2$. The radar IF signal, being transmitted to and from fusion center 2 and dipole antennas 38 of the array, is also represented. When not in use, array 26 may be retracted by roller 42 and stored.

As was disclosed above, by using transmitter 22, the summed optical signal can be directed onto array 26. This transmission of the summed optical signal may be done, however, in a scanning or stepping fashion, such that each of the TR modules 34 is exposed individually, but at a high enough frequency that no discontinuity is discerned. Also, depending on the intensity available for the summed optical signal, either different groups of TR modules 34 or the entire array of TR modules may also be exposed at any one time. The respective TR modules may be combined as a corporate feed or transmitter. Since all of the TR modules of the array are illuminated by this summed optical signal, which has multiplexed thereon the oscillator signal, TR modules 34 are all synchronized locally and may be triggered in accordance with pulse train 12. And because the summed optical signal is operating at optical wavelengths and can be emitted from transmitter 22 as a narrow beam, it is extremely difficult to jam.

Figure 2:
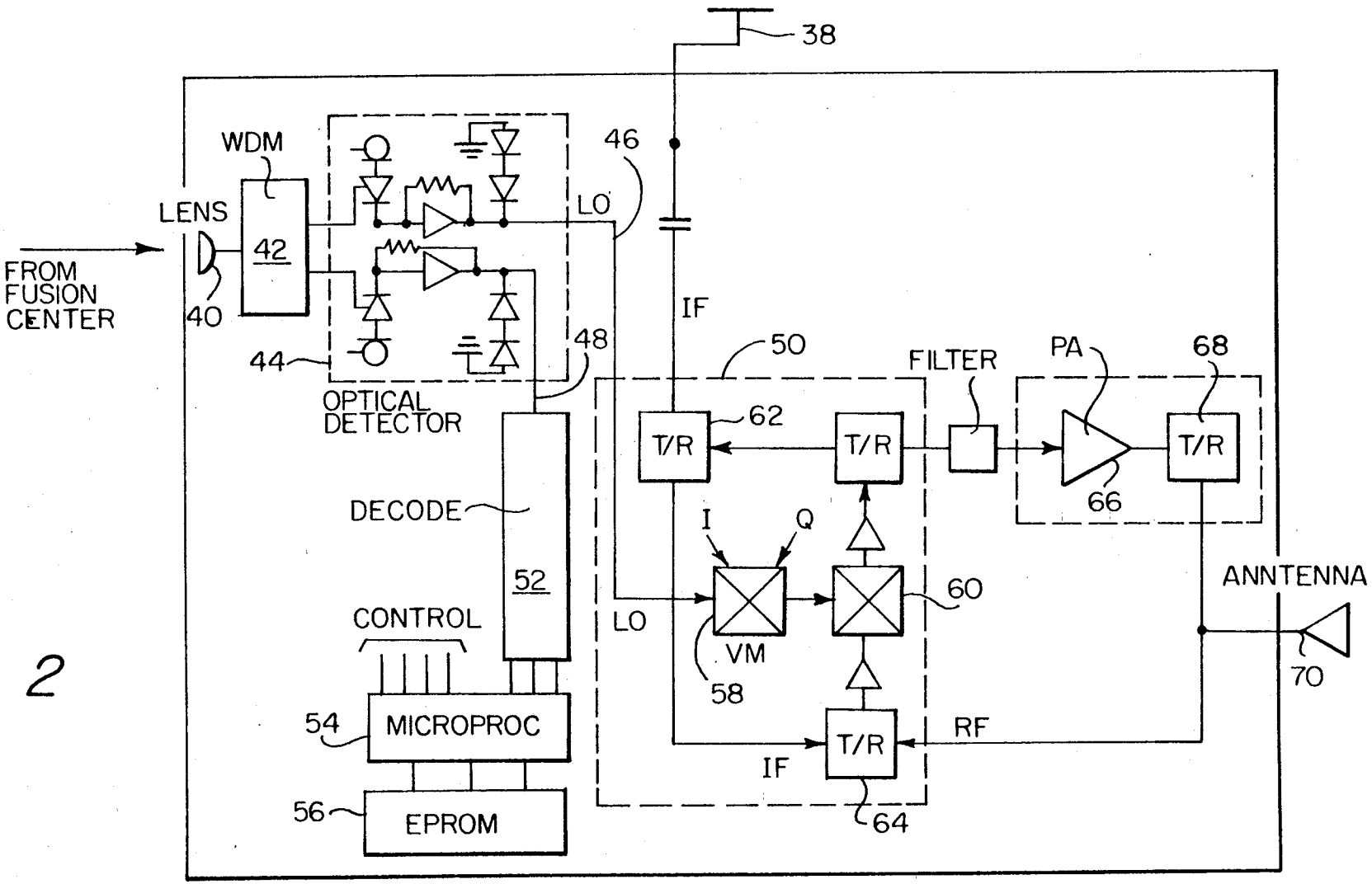
FIG. 2 is a simplified block diagram of one of the TR modules.

The respective components and operation of a representative TR module 34 is shown in FIG. 2. There, it can be seen that the summed optical signal from fusion center 2 is received by lens 40 and focused onto a conventional wavelength division demultiplexer 42. Demultiplexer 42 separates the multiplexed oscillator signal and command signal from the summed optical signal and feeds the same to an optical detector 44, otherwise known as a transimpedance amplifier made by number of companies including Hewett-Packard, Motorola and Tachonics. Optical detector 44 converts the respective separated oscillator and command optical signals into corresponding electrical signals provided at lines 46 and 48. The electrical oscillator signal is fed to a mixer 50 while the electrical command signal is fed to a decoder 52. The control signal which corresponds to this given TR module and is recognized thereby, after being deciphered by decoder 52 and fed to microprocessor 54, provides control parameters, obtained from storage 56, to provide controls for the TR module. Within mixer 50, which may be a floating FET, the oscillator signal is fed to a phase shifting modulator 58, which may be a vector modulator, and is modulated with a given phase and amplitude, by means of the preset in-phase and quadrature characteristics of phase shifting modulator 58. The thus modulated oscillator signal is then sent to another modulator 60 which also has as another input the radar IF signal, which has been fed thereto through a number of transmit/receive (T/R) switches 62 and 64. The radar signal is linearly modulated with the oscillator signal and the thus modulated radar signal is fed, through a filter, a power amplifier 66 and yet another T/R switch 68, before being transmitted, via antenna 70, toward an of-interest target.

Given the controls provided by the command signal, each one of the thus transmitted modulated radar signal, particularly with regard to its phase and amplitude, is weighted, relative to the other modulated radar signals, from the rest of the TR modules of the array. Therefore, when all of the modulated radar signals are transmitted from the antennas of the respective TR modules, a coherently synchronized radar wave front is produced.

When this synchronize coherent wave front impinges the of-interest target, it is reflected, as an echo, back toward the TR modules of the array. With the proper synchronization and setting of the different T/R switches, each TR module is capable of receiving the echo signal. When received, for example with reference to the TR module of FIG. 2, the echo signal is fed back to mixer 50 where it is down modulated by the oscillator signal in modulators 60 and 58. After which the thus down modulated echo signal is fed, by means of dipole antenna 38, to fusion center 2. The combination of the respective down modulated echo signals allows fusion center 2 to calculate, by well known and conventional techniques, the angular location of the of-interest target.

Inasmuch as the present invention is subjected to many variations, modifications and changes in detail, it is intended that all matter described throughout this specification and shown in the accompanying drawings be interpreted as illustrative only and not in a limiting sense. Accordingly, it is intended that the invention be limited only by the spirit and scope of the appended claims.

We claim:

1. Apparatus for synchronously controlling an array of TR modules, comprising:

a processing center including means for generating a plurality of optical signals and a radar signal;

means for spatially sending the radar signal to each of the TR modules of the array;

means for generating one optical signal representative of an oscillator signal;

means for generating another optical signal representative of a command signal including a plurality of control signals each recognizable and to be used by a corresponding one of the TR modules;

means for summing the respective optical signals as a summed optical signal;

means for spatially beaming the summed optical signal to each TR module of the array;

wherein each of the TR modules includes:

means for receiving the beamed summed optical signal;

demultiplexing means for separating from the summed optical signal the oscillator signal and a corresponding recognized control signal from the command signal;

means for linearly modulating the radar signal with the oscillator signal;

decoder means for decoding the corresponding recognized control signal to provide the modulated radar signal with the amplitude and phase which synchronously relate to corresponding amplitudes and phases of the respective modulated radar signals being generated in the other TR modules of the array;

wherein the respective modulated radar signals, being transmitted by corresponding antennas from all of the TR modules, in combination, effect a coherently synchronized radar wave front for transmission to an of interest target.

2. The apparatus of claim 1, wherein the generating means of the representative oscillator signal comprises:

a modulator for multiplexing onto the one optical signal a predetermined pulse train to generate the oscillator signal; and wherein the generating means of the representative command signal comprises:

another modulator for multiplexing onto the other optical signal another pulse train to generate the command signal.

3. The apparatus of claim 1, wherein the summing means comprises:

a wavelength division multiplexer for combining the one and other optical signals; and the apparatus further comprising:

a transmitting means for spatially transmitting the combined optical signals to the array of TR modules.

4. The apparatus of claim 1, wherein the array of TR modules comprises:

a flexible sheet having integrated thereon the TR modules, the receiving means of each TR module being a lens mounted substantially over the TR module for receiving the beamed summed optical signal;

wherein the sheet is retracted and stored when the array is not in use.

5. The apparatus of claim 1, wherein for each TR module, the demultiplexing means comprises:

an optical wavelength division demultiplexer; and wherein the receiving means of each TR module further comprises:

a lens for collecting the summed optical signal sent thereto, the lens focusing the collected summed optical signal onto the corresponding optical wavelength division demultiplexer.

6. The apparatus of claim 1, wherein each TR module further comprises:

switching means to activate the TR module to receive, via its corresponding antenna, a signal representative of an echo of the target hit by the coherently synchronized radar wave front, the echo signal being linearly down modulated with the corresponding oscillator signal and transmitted to the processing center to combine with the down modulated echo signals from the other TR modules to calculate the location of the target.

7. The apparatus of claim 1, wherein the spatially beaming means comprises:

motor means to actuate a reflector to direct the summed optical signal to each of the TR modules.

8. The apparatus of claim 1, wherein the spatially beaming means comprises:

lens means for focusing the summed optical signal onto the array of TR modules.

9. The apparatus of claim 1, wherein the linearly modulating means comprises:

a phase shifting modulator for modulating the radar signal with the oscillator signal and providing in-phase and qradrature components to the radar signal.

10. The apparatus of claim 1, further comprising:

an optical detector for converting the separated oscillator signal and the corresponding recognized control signal to appropriate electrical signals, and for routing the thus converted electrical oscillator signal to the modulating means and the electrical control signal to the decoder means.

11. Apparatus for synchronously controlling an array of TR modules, comprising:

a processing center including means for generating a plurality of optical signals, a radar signal, an oscillator signal and a plurality of command signals;

means for spatially sending the radar signal to each of the TR modules of the array;

means for multiplexing the oscillator signal onto one of the optical signals;

means for multiplexing the plurality of command signals onto corresponding other optical signals, each command signal being used for a corresponding one of the TR modules;

means for summing the respective optical signals as a single summed optical signal;

means for spatially beaming the summed optical signal to the array;

wherein each of the TR modules includes:

means for receiving the beamed summed optical signal;

demultiplexing means for separating the oscillator signal and the corresponding command signal from the summed optical signal;

means for linearly modulating the radar signal with the oscillator signal, the oscillator signal acting as a local oscillator for the TR module;

decoder means for decoding the command signal to provide the modulated radar signal with amplitude and phase which synchronously relate to corresponding amplitudes and phases of the respective modulated radar signals being generated in the other TR modules of the array;

an antenna for transmitting the modulated radar signal which, together with other modulated radar signals being transmitted by antennas from the other TR modules, effecting a coherently synchronized radar wave front for transmission to an of interest target.

12. The apparatus of claim 11, wherein the summing means comprises:

a wavelength division multiplexer for combining the one and other optical signals; and the apparatus further comprising:

a transmitting means for spatially transmitting the combined optical signals to the array of TR modules.

13. The apparatus of claim 11, wherein the demultiplexer means comprises:

an optical wavelength division demultiplexer within the TR module for separating the oscillator signal and the corresponding control signal from the summed optical signal.

14. The apparatus of claim 1, wherein each TR module further comprises:

switching means to activate the TR module to receive, via its antenna, a signal representative of an echo of the target hit by the coherently synchronized radar wave front, the echo signal being linearly down modulated with the corresponding oscillator signal and transmitted to the processing center to combine with the down modulated echo signals from the other TR modules to calculate the location of the target.

15. A method of synchronously controlling an array of TR modules, comprising the steps of:

spatially sending a radar signal to the respective TR modules of the array;

multiplexing an oscillator signal onto one optical signal;

multiplexing onto another optical signal a command signal having respective control signals each recognizable and to be used by a corresponding one of the TR modules of the array;

summing the respective optical signals into a single summed optical signal and directing the summed optical signal to a spatial transporting means;

spatially beaming the summed optical signal to each TR module of the array;

separating from the summed optical signal the oscillator signal and a corresponding recognized control signal from the command signal for each TR module;

linearly modulating the radar signal with the oscillator signal in each TR module;

utilizing the corresponding recognized control signals to weighted the phase and amplitude of the respective modulated radar signals in each of the TR modules, the phase and amplitude for each TR module being thus synchronized with the respective phases and amplitudes of the other TR modules of the array;

sending the respective weighted radar signals, via corresponding antennas from the TR modules, to an of interest target, the weighted radar signals, in combination, effecting a coherently synchronized radar wave front.

16. The method of claim 15, wherein the spatially beaming step comprises the step of:

actuating a reflector to direct the summed optical signal toward each TR module of the array.

17. The method of claim 15, wherein the spatially beaming step comprises the step of:

utilizing a lens to focus the summed optical signal to the array.

18. The method of claim 15, further comprising the steps of:

converting the oscillator signal and the corresponding recognized control signal from the command signal for each TR module to corresponding electrical signals;

wherein for each TR module:

routing the electrical oscillator signal to a phase shifting modulator to modulate the radar signal; and routing the electrical recognized control signal to a decoder means to determine the proper weighted to apply to the phase and amplitude for the TR module.

19. The method of claim 15, further comprising the steps of:

receiving, via the antennas of the TR modules, corresponding signals of an echo of the transmitted coherently synchronized radar wave front representative of the of interest target;

down modulating the received echo signals with the corresponding oscillator signals to generate corresponding down modulated echo signals; and transmitting the corresponding down modulated echo signals to a processing means to determine the location of the of-interest target.

* * * * *

UNITED STATES PATENT AND TRADEMARK OFFICE

CERTIFICATE OF CORRECTION

PATENT NO. : 5,164,735

DATED : November 17, 1992

INVENTOR(S) : Stanley M. Reich, et al.

It is certified that error appears in the above-identified patent and that said Letters Patent is hereby corrected as shown below:

Column 1, line 44, change "o" to --of--;

Column 1, line 59, change "command signal" to --command signals--;

Column 1, line 67, change "receives" to --receive--.

Column 2, line 10, change "containing" to --contained--;

Column 2, line 27, change "objection" to --objective--.

Column 3, line 57, change "Scannino" to --Scanning--;

Column 3, line 62, change "moveable" to --movable--.

Column 4, line 2, change "is" to --are--;

Column 4, line 2, delete "an";

Column 4, line 3, change "signal" to --signals--;

Column 4, line 59, after "by" insert --a--;

Column 4, line 60, change "Hewett" to --Hewlett--.

UNITED STATES PATENT AND TRADEMARK OFFICE

CERTIFICATE OF CORRECTION

PATENT NO. : 5,164,735

DATED : November 17, 1992

INVENTOR(S) : Stanley M. Reich, et al.

It is certified that error appears in the above-identified patent and that said Letters Patent is hereby corrected as shown below:

Column 5, line 18, change "signal" to --signals--;

Column 5, line 25, change "synchronize" to --synchronized--.

Column 7, line 9, change "qradrature" to --quadrature--;

Column 7, line 54, change "effecting" to --effect--.

Column 8, line 37, change "weighted" to --weight--;

Column 8, line 66, change "weighted" to --weight--.

Signed and Sealed this

Fifth Day of October, 1993

*Attest:*

Bruce Lehman

BRUCE LEHMAN

*Attesting Officer*

*Commissioner of Patents and Trademarks*